US005209820A

United States Patent [19]

Tytgat et al.

[11] Patent Number: 5,209,820

[45] Date of Patent: May 11, 1993

[54] BATHS AND PROCESS FOR THE CHEMICAL POLISHING OF STAINLESS STEEL SURFACES

[75] Inventors: Daniel Tytgat, Brussels; Nathalie Barthelemy, Orp-Jauche, both of Belgium

[73] Assignee: Solvay & Cie (Societe Anonyme), Brussels, Belgium

[21] Appl. No.: 712,961

[22] Filed: Jun. 10, 1991

[30] Foreign Application Priority Data

Jun. 19, 1990 [BE] Belgium ..... 09000625

[51] Int. Cl.[5] ..... B44C 1/22; C23F 1/00

[52] U.S. Cl. ..... 156/664; 156/903; 252/79.4

[58] Field of Search ..... 252/79.2, 79.4, 142; 156/656, 664, 903; 204/129.1; 134/3, 41

[56] References Cited

U.S. PATENT DOCUMENTS

| | | | |
|---|---|---|---|
| 2,662,814 | 12/1953 | Swihart | 252/79.4 X |
| 3,072,515 | 1/1963 | Von Smolinski et al. | 252/79.4 X |
| 3,457,107 | 7/1969 | Mickelson et al. | 134/3 |
| 3,709,824 | 1/1973 | Oda et al. | 252/142 |
| 3,839,112 | 10/1974 | Arciniega | 156/20 |
| 4,678,541 | 7/1987 | Tytgat et al. | 156/664 |

FOREIGN PATENT DOCUMENTS

| | | | |
|---|---|---|---|
| 0019964 | 12/1980 | European Pat. Off. | 252/79.4 |
| 0206386 | 5/1986 | European Pat. Off. . | |
| 0274776 | 12/1987 | European Pat. Off. . | |
| 0042673 | 10/1981 | Japan | 252/79.4 |
| 734665 | 8/1955 | United Kingdom . | |

OTHER PUBLICATIONS

Soviet Inventors Illustrated, Section Ch, Semaine 8507, Mar. 27, 1985, Resume No. 84-043610/07.

Chemical Abstracts, vol. 81, No. 2, Jul. 15, 1974, p. 92, Resume No. 5454h.

Tegart, "The Electrolytic and Chemical Polishing of Metals in Research and Industry," Pergamon Press (1959) pp. 96-109.

*Primary Examiner*—William A. Powell

*Attorney, Agent, or Firm*—Willian Brinks Olds Hofer Gilson & Lione

[57] ABSTRACT

Baths for the chemical polishing of stainless steel surfaces which comprise a mixture of hydrochloric acid, nitric acid and phosphoric acid, a substituted or unsubstituted hydroxybenzoic acid and an amine in aqueous solution.

13 Claims, No Drawings

BATHS AND PROCESS FOR THE CHEMICAL POLISHING OF STAINLESS STEEL SURFACES

The present invention relates to the composition of baths for the chemical polishing of stainless steel surfaces.

The chemical polishing of metal surfaces is a well known technique (Polissage électrolytique et chimique des métaux (Electrolytic and chemical polishing of metals)—W.J. Mc G. TEGART—Dunod—1960—p. 122 et seq.); it consists in treating the metal surfaces to be polished with oxidising baths. For the chemical polishing of austenitic stainless steels, baths are usually used which comprise a mixture of hydrochloric, phosphoric and nitric acids in aqueous solution (U.S. Pat. No. 2,662,814). In order to improve the quality of polishing, it is customary to incorporate in these baths suitable additives, such as surface-active agents, viscosity regulators and brighteners. Thus, in U.S. Pat. No. 3,709,824, a composition of a bath for the chemical polishing of stainless steel surfaces is described which comprises a mixture of hydrochloric, nitric and phosphoric acid in aqueous solution, a viscosity regulator chosen from water-soluble polymers, a surfactant and sulphosalicylic acid as brightener.

These known polishing baths have the specific feature of attacking the metal very rapidly. A polishing treatment of a stainless steel surface with such baths must in general not exceed a few minutes for risk of causing local corrosions. This high rate of action of known polishing baths is a disadvantage, because they are made unusable for certain applications, especially for the polishing of inner wall surfaces of containers of large dimensions, such as boilers, autoclaves and crystallisers. Since the time required for filling and emptying such containers is in general far longer than the duration of the optimum chemical polishing treatment, it becomes in fact impossible to obtain uniform polishing of the wall, since certain areas thereof are insufficiently polished and others are strongly corroded. The high rate of action of the known chemical polishing baths furthermore makes it difficult to control the polishing.

In Patent EP-B-19,964 (SOLVAY & Cie), chemical polishing baths having a slow action are described, which consequently avoid the abovementioned disadvantages. These known baths comprise a mixture of hydrochloric, nitric and phosphoric acids, sulphosalicylic acid, alkylpyridinium chloride and methylcellulose in aqueous solution. These known polishing baths having a slow action are designed for operation at temperatures at least equal to 40° C., in general between 45° and 100° C.

The invention aims to provide baths designed to achieve slow and efficient chemical polishing of stainless steel surfaces at operating temperatures below 50° C.

Consequently, the invention relates to baths for the chemical polishing of stainless steel surfaces which comprise a mixture of hydrochloric, nitric and phosphoric acid, a substituted or unsubstituted hydroxybenzoic acid and a water-soluble amine in aqueous solution.

In the baths according to the invention, the hydroxybenzoic acid serves as a brightener. It can be unsubstituted, such as salicylic acid, or substituted, such as sulphosalicylic acid. Salicylic acid is preferred.

The amine can be selected from primary amines, secondary amines and tertiary amines. Amines whose molecule comprises more than 10 carbon atoms, for example between 11 and 20 carbon atoms, are preferred. Primary alkylamines comprising 11 to 16 carbon atoms in their molecule are preferred. The baths according to the invention can comprise a mixture of amines. The optimum amine content depends on the nature of the amine selected. As a general rule, it is between 0.001 and 1 g per liter of aqueous solution.

In a particular embodiment of the invention, the aqueous solution of the bath comprises, in addition to the amine, an additive selected from perchloric acid and the water-soluble salts of perchloric acid. The optimum content of this additive is between 0.001 and 0.5 mol per liter of aqueous solution.

In another embodiment of the baths according to the invention, the aqueous solution contains a water-soluble additive capable of decomposing nitrous acid. This additive has the function of decomposing at least a portion of the nitrous acid which is formed during the polishing of a stainless steel surface as a result of oxidation of ferrous ions liberated in the bath in the course of polishing. It is preferably selected from urea and its derivatives, such as thiourea and ureines, and its optimum content is between 0.01 and 5 g per liter of aqueous solution The baths in accordance with this embodiment of the invention are specially adapted to the polishing treatment in which the ratio between the surface in contact with the bath and its volume is greater than $10\ m^{-1}$.

The baths according to the invention are preferably free of ferricyanide and ferrocyanide ions, especially when they do not contain perchloric acid.

The appropriate weight proportions of the various constituents of the baths according to the invention depend on the stainless steel grade subjected to polishing and to the polishing conditions, especially the profile of the steel article subjected to polishing, its volume, the volume of the bath, its temperature and the stirring to which it may or may not be subjected. Consequently, they have to be determined in each particular case by routine tests in the laboratory. Examples of baths according to the invention suitable for the polishing of austenitic stainless steels alloyed with chromium and with nickel at temperatures between 20° and 50° C. comprise, per liter of aqueous solution, between 0.5 and 5 mol of hydrochloric acid (preferably 1–3 mol), between 0.005 and 1 mol of nitric acid (preferably 0.05–0.5 mol), between 0.005 and 1 mol of phosphoric acid (preferably 0.01–0.5 mol), between 0.001 and 5 g of substituted or unsubstituted hydroxybenzoic acid (preferably 0.005–0.3 g, in the case of the unsubstituted acid), between 0.001 and 1 g of amine (preferably 0.005–0.300 g), between 0 and 0.5 mol of the additive selected from perchloric acid and the water-soluble salts of perchloric acid (preferably 0.001–0.2 mol), between 0 and 5 g of the additive capable of decomposing nitrous acid (preferably 0.01 and 5 g).

If desired, the polishing baths according to the invention can contain additives usually present in the known baths for the chemical polishing of metals, for example surface-active agents, alcohols and viscosity regulators. They can especially contain a water-soluble abietic compound which is a chemical compound comprising an abietyl radical of the general formula:

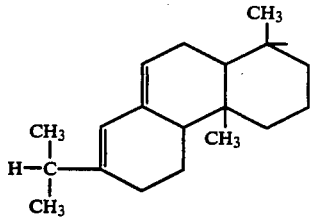

or a hydroabietyl or dehydroabietyl radical.

In accordance with the invention, the abietic compound must be soluble in the aqueous solution.

Abietic compounds which can be used in the baths according to the invention are abietamines.

Especially recommended abietamines for the baths according to the invention are those of the general formula:

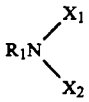

in which:

$R_1$ represents an abietyl, hydroabietyl or dehydroabietyl radical defined above, $X_1$ represents a radical comprising at least a carbonyl group and $X_2$ represents a hydrogen atom or a radical comprising at least one carbonyl group.

Examples of abietamines of this type which are suitable in the baths according to the invention are those in which at least one of the radicals $X_1$ and $X_2$ is a radical of the general formula:

$$-CH_2-R_2$$

in which $R_2$ represents a linear or cyclic, substituted or unsubstituted, saturated or unsaturated alkyl radical comprising at least one carbonyl group. Of these compounds, those are preferred in which the group $-CH_2-$ is bound to a carbonyl group of the radical $R_2$ via a carbon atom carrying at least one hydrogen atom. Substituted abietamines of this type and their preparation method are described in Patent GB-A-734,665. Examples of abietamines of this type which can be used in the baths according to the invention are those in which the alkyl radical $R_2$ is selected from acetonyl, 2-oxobutyl, 4-methyl-2-oxo-3-pentenyl, 4-hydroxy-4-methyl-2-oxopentyl-, 2-oxocyclopentyl, 4-hydroxy-2-oxo-3-pentenyl, 2-oxocyclohexyl, 2,5-dioxohexyl and 2-phenyl-2-oxoethyl radicals.

The baths according to the invention can likewise contain products of the trade name DEHYQUART (Henkel), which are surface-active agents selected from alkylpyridinium and quaternary ammonium salts and comprising substituted or unsubstituted alkyl, phenyl or benzyl radicals.

The baths according to the invention are suitable for the chemical polishing of any austenitic stainless steel surfaces. They are especially suited to the polishing of austenitic steel containing between 16 and 26% by weight of chromium and between 6 and 22% by weight of nickel, such as the steel grades 18/8 and 18/10, and, if desired, containing molybdenum (for example the steels AISI-304, 304L, 316 and 316L). The baths according to the invention have the special feature of achieving polishing of these steels at a low speed, generally requiring a contact time of between 3 and 12 hours. They can be used at any temperatures between 20° C. and the boiling temperature. However, they have the remarkable feature of having excellent efficiency at temperatures below 50° C., in general between 35° and 45° C. at standard atmospheric pressure, thus facilitating their use and simplifying the measures to be taken for ensuring a healthy atmosphere in polishing workshops. The baths according to the invention have the additional advantage of achieving high-quality polishing of welded joints according to the state of the art.

The invention also relates to a process for the polishing of a stainless steel surface, according to which the surface is brought into contact with a chemical polishing bath according to the invention.

When carrying out the process according to the invention, the metal surface can be brought into contact with the bath in any suitable manner, for example by immersion. The contact time of the surface to be polished with the bath must be sufficiently long for achieving efficient polishing of the surface. However, it must not exceed a critical value beyond which the bath loses its polishing properties. The optimum contact time depends on many parameters, such as the steel grade, the structure and initial roughness of the surface to be polished, the composition of the bath, the operating temperature, the agitation of the bath in contact with the surface, the ratio between the surface area to be polished and the volume of the bath; it has to be determined in each particular case by a routine test in the laboratory.

In a preferred embodiment of the process according to the invention, the bath is used at a temperature between 20° and 65° C., preferably between 35° and 50° C., at standard atmospheric pressure, and the surface to be polished is maintained in contact with the bath for a period between 5 and 12 hours.

The advantage of the invention will become evident on reading the examples described below.

In the examples which are described below, stainless steel sheets of grade 18/10 [steel alloyed with chromium (18.0%) and nickel (10.0%) and free of molybdenum] were used.

In each example, the sheet was immersed in the polishing bath, which was maintained at a substantially constant temperature and subjected to moderate agitation. At the conclusion of the immersion period, the sheet was removed from the bath, rinsed with demineralised water and dried. The following parameters were measured:

the average depth of attack of the metal, defined by the relationship $$\Delta e = \frac{10^4}{S \cdot d} \cdot \Delta P$$

where

S denotes the area of the sheet (in $cm^2$), d denotes the specific weight of the metal (in $g/cm^3$), $\Delta P$ denotes the weight loss (in g) of the sheet during immersion in the bath, $\Delta e$ denotes the depth of attack ($\mu m$);

the mean arithmetic roughness $R_a$, which is the mean deviation, with respect to the mean surface of the sheet [Encyclopedia of Materials Science and Engineering, Michael B. Bever, Vol. 6, 1986, Pergamon Press, pages 4806 to 4808 (page 4806)]:

$$R_a = \frac{1}{L}\int_0^L |y(x)|\,dx$$

the measurements being carried out using a tracer equipped with a tip having a radius of curvature of 5 μm and the computer operating with a cut-off value of 0.25 mm;

the surface gloss under an incident angle of 20 degrees (according to ASTM Standard D523).

First series of examples: examples according to the invention

EXAMPLE 1

A polishing bath according to the invention was used comprising per liter:
1.3 mol of hydrochloric acid,
0.25 mol of nitric acid,
0.15 mol of phosphoric acid,
0.1 g of salicylic acid,
0.1 g of tripentylamine,
0.005 mol of perchloric acid.

The operating conditions were as follows:
volume of the bath: 970 $cm^3$,
surface area subjected to polishing: 87.3 $cm^2$,
temperature: 45° C.,
duration of the immersion: 3 hours 30 minutes.

The following results were found:
mean arithmetic roughness:
before polishing: 0.29 μm,
after polishing: 0.21 μm,
gloss: 12%.

EXAMPLE 2

A polishing bath according to the invention was used comprising per liter:
1.5 mol of hydrochloric acid,
0.2 mol of nitric acid,
0.2 mol of phosphoric acid,
0.1 g of salicylic acid,
0.075 g of trioctylamine,
0.005 mol of perchloric acid.

The operating conditions were as follows:
volume of the bath: 970 $cm^3$,
surface area subjected to polishing: 87.3 $cm^2$,
temperature: 45° C.,
duration of the immersion: 3 hours 15 minutes.

The following results were found:
depth of attack 31.3 μm,
mean arithmetic roughness:
before polishing: 0.29 μm,
after polishing: 0.18 μm,
gloss: 17%.

EXAMPLE 3

A polishing bath according to the invention was used comprising per liter:
1.5 mol of hydrochloric acid,
0.2 mol of nitric acid,
0.2 mol of phosphoric acid,
0.1 g of salicylic acid,
0.075 g of dihexylamine,
0.005 mol of perchloric acid.

The operating conditions were as follows:
volume of the bath: 970 $cm^3$,
surface area subjected to polishing: 87.3 $cm^2$,
temperature: 45° C.,
duration of the immersion: 3 hours 25 minutes.

The following results were found:
depth of attack: 27.1 μm,
mean arithmetic roughness:
before polishing: 0.31 μm,
after polishing: 0.22 μm,
gloss: 13%.

EXAMPLE 4

A polishing bath according to the invention was used comprising per liter:
1.5 mol of hydrochloric acid,
0.2 mol of nitric acid,
0.2 mol of phosphoric acid,
0.1 g of salicylic acid,
0.075 g of laurylamine, The operating conditions were as follows:
volume of the bath: 970 $cm^3$,
surface area subjected to polishing: 87.3 $cm^2$,
temperature: 45° C.,
duration of the immersion 3 hours 50 minutes.

The following results were found:
depth of attack: 25.1 μm,
mean arithmetic roughness:
before polishing: 0.28 μm,
after polishing: 0.09 μm,
gloss: 36%.

EXAMPLE 5

A polishing bath according to the invention was used comprising per liter:
1.5 mol of hydrochloric acid,
0.2 mol of nitric acid,
0.2 mol of phosphoric acid,
0.1 g of salicylic acid,
0.075 g of laurylamine,
0.005 mol of perchloric acid.

The operating conditions were as follows:
volume of the bath: 970 $cm^3$,
surface area subjected to polishing: 87.3 $cm^2$,
temperature: 45° C.,
duration of the immersion: 4 hours.

The following results were found:
depth of attack: 27.3 μm,
mean arithmetic roughness:
before polishing: 0.27 μm,
after polishing: 0.08 μm,
gloss: 38%.

EXAMPLE 6

A polishing bath according to the invention was used comprising per liter:
1.5 mol of hydrochloric acid,
0.2 mol of nitric acid,
0.2 mol of phosphoric acid,
0.1 g of salicylic acid,
0.075 g of laurylamine,
0.005 mol of perchloric acid,
0.1 g of urea.

The operating conditions were as follows:
volume of the bath: 725 $cm^3$,
surface area subjected to polishing: 87.3 $cm^2$,
temperature: 45° C.,
duration of the immersion: 4 hours.

The following results were found:
depth of attack: 26.2 μm,
mean arithmetic roughness:
before polishing: 0.22 μm,
after polishing: 0.07 μm,
gloss: 37%.

EXAMPLE 7

A polishing bath according to the invention was used comprising per liter:
1.3 mol of hydrochloric acid,
0.2 mol of nitric acid,
0.1 mol of phosphoric acid,
0.2 g of salicylic acid,
0.1 g of tridecylamine,
0.005 mol of perchloric acid, The operating conditions were as follows:
volume of the bath: 930 $cm^3$,
surface area subjected to polishing: 84 $cm^2$,
temperature: 45° C.,
duration of the immersion: 4 hours 50 minutes.

The following results were found:
mean depth of attack: 38.6 μm,
mean arithmetic roughness:
before polishing: 0.25 μm,
after polishing: 0.10 μm,
gloss: 33%.

EXAMPLE 8

A polishing bath according to the invention was used comprising per liter:
1.6 mol of hydrochloric acid,
0.2 mol of nitric acid,
0.2 mol of phosphoric acid,
0.1 g of salicylic acid,
0.075 g of dodecylamine,
0.005 mol of perchloric acid,
0.5 g of urea.

The operating conditions were as follows:
volume of the bath: 1,050 $cm^3$,
surface area subjected to polishing: 63 $cm^2$,
temperature: 35° C.,
duration of the immersion: 8 hours 40 minutes.

The following results were found:
mean depth of attack: 30 μm,
mean arithmetic roughness:
before polishing: 0.25 μm,
after polishing: 0.09 μm,
gloss: 28%.

EXAMPLE 9

A polishing bath according to the invention was used comprising per liter:
1.7 mol of hydrochloric acid,
0.2 mol of nitric acid,
0.25 mol of phosphoric acid,
0.1 g of salicylic acid,
0.050 g of myristylamine,
0.005 mol of perchloric acid, The operating conditions were as follows:
volume of the bath: 970 $cm^2$,
surface area subjected to polishing: 87.3 $cm^2$,
temperature: 45° C.
duration of the immersion: 3 hours 50 minutes.

The following results were found:
mean arithmetic roughness:
before polishing: 0.22 μm,
after polishing: 0.11 μm,
gloss: 21%.

Second series of examples: reference examples

This series of examples relates to experiments which were carried out with baths which are not according to the invention.

EXAMPLE 10

A polishing bath was used comprising per liter:
1.5 mol of hydrochloric acid,
0.2 mol of nitric acid,
0.2 mol of phosphoric acid,
0.1 g of salicylic acid.

The operating conditions were as follows:
volume of the bath: 970 $cm^3$,
surface area subjected to polishing: 87.3 $cm^2$,
temperature: 45° C.,
duration of the immersion: 3 hours.

The following results were found:
depth of attack: 29 μm,
mean arithmetic roughness:
before polishing: 0.26 μm,
after polishing: 0.23 μm,
gloss: 7%.

EXAMPLE 11

A polishing bath was used comprising per liter:
1.5 mol of hydrochloric acid,
0.2 mol of nitric acid,
0.2 mol of phosphoric acid,
0.1 g of salicylic acid,
0.005 mol of perchloric acid.

The operating conditions were as follows:
volume of the bath: 970 $cm^3$,
surface area subjected to polishing: 87.3 $cm^2$,
temperature: 45° C.,
duration of the immersion: 3 hours.

The following results were found:
depth of attack: 31.2 μm,
mean arithmetic roughness:
before polishing: 0.24 μm,
after polishing: 0.22 μm,
gloss: 8%.

Comparison of the results obtained in Examples 1 to 9 with those obtained in Examples 10 and 11 shows the progress provided by the invention with respect to roughness and gloss obtained on completion of polishing.

We claim:

1. A bath for the chemical polishing of stainless steel surfaces, comprising a mixture of hydrochloric acid, nitric acid and phosphoric acid, and a substituted or unsubstituted hydroxybenzoic acid in aqueous solution, characterised in that they comprise a water-soluble amine in the aqueous solution.

2. The bath according to claim 1, the amine comprising more than 10 carbon atoms in its molecule.

3. The bath according to claim 2, wherein the number of carbon atoms in the amine is between 11 and 20.

4. The bath according to claim 3, wherein the amine is a primary amine comprising between 12 and 18 carbon atoms.

5. The bath according to any one of claims 1 to 4, wherein the amine is present in the aqueous solution in an amount between 1 and 1,000 mg per liter of solution.

6. The bath according to claim 1 free of ferricyanide ions and ferrocyanide ions.

7. The bath according to claim 1, wherein an additive selected from perchloric acid and the water-soluble salts of perchloric acid in the aqueous solution.

8. The bath according to claim 1, comprising an additive capable of decomposing nitrous acid in the aqueous solution.

9. The bath according to claim 8, wherein the additive capable of decomposing nitrous acid is selected from urea and urea derivatives.

10. The bath according to claim 1, comprising per liter of aqueous solution, between 0.5 and 5 mol of hydrochloric acid,
between 0.005 and 1 mol of nitric acid,
between 0.005 and 1 mol of phosphoric acid,
between 0.001 and 5 g of hydroxybenzoic acid,
between 0.001 and 1 g of amine,
between 0 and 0.5 mol of the additive selected from perchloric acid and the water-soluble salts of perchloric acid
between 0 and 0.500 g of the additive capable of decomposing nitrous acid.

11. The bath according to claim 1, utilized for the chemical polishing of austenitic steel surfaces.

12. Process for the polishing of a stainless steel surface, according to which the surface is brought into contact with a bath for chemical polishing, characterised in that a bath according to any one of claims 1 to 11 is used.

13. Process according to claim 12, characterised in that the temperature of the bath is regulated between 20° and 65° C.

* * * * *